US006506094B1

(12) United States Patent
Chang

(10) Patent No.: US 6,506,094 B1
(45) Date of Patent: Jan. 14, 2003

(54) PUPPET ASSEMBLY

(76) Inventor: Chao-Tsung Chang, 100, Kuang-Hui St., Taichung City (TW)

( * ) Notice: Subject to any disclaimer, the term of this patent is extended or adjusted under 35 U.S.C. 154(b) by 0 days.

(21) Appl. No.: 09/718,301

(22) Filed: Nov. 24, 2000

(51) Int. Cl.[7] ..... A63H 3/16
(52) U.S. Cl. ..... 446/268; 446/69; 446/97
(58) Field of Search ..... 446/69, 97, 268, 446/487

(56) References Cited

U.S. PATENT DOCUMENTS 2,927,397 A * 3/1960 Wilson
3,583,059 A * 6/1971 Ceolin
4,356,659 A * 11/1982 Clarke
4,879,838 A * 11/1989 Vicenes
5,814,380 A * 9/1998 Tamborello et al.

* cited by examiner

*Primary Examiner*—John A. Ricci
(74) *Attorney, Agent, or Firm*—Charles E. Baxley

(57) ABSTRACT

A doll assembly includes a first section, a second section and a third section. The three sections are disengagably connected with each other. The third section has an open end through which the first section and the second section are received in the third section.

4 Claims, 4 Drawing Sheets

PUPPET ASSEMBLY

FIELD OF THE INVENTION

The present invention relates to a doll assembly comprising three sections and one of which is large enough to receive the other two sections so as to become a compact size for convenience of transportation and storage.

BACKGROUND OF THE INVENTION

A conventional doll 10 is shown in FIG. 4 and generally is a one-piece product. FIG. 1 is a snowman doll which is sold close to the Christmas and such a big doll 10 requires a large space to keep and in order to prevent from scrubbing or damaging the doll 10, an even larger package box 11 is required. A home could have more than one doll so that how to easily store these dolls is a problem that the customers focus on and concern.

The present invention intends to provide a doll assembly comprising three sections which are easily assembled, one section is large enough to receive the rest two sections.

SUMMARY OF THE INVENTION

In accordance with one aspect of the present invention, there is provided a doll assembly which comprises a first section, a second section and a third section. The three sections are disengagably connected with each other. The third section has an open end through which the first section and the second section are received in the third section.

The primary object of the present invention is to provide a doll assembly composed of three sections and one of the three sections is able to receive the rest two sections so as to become a compact size.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
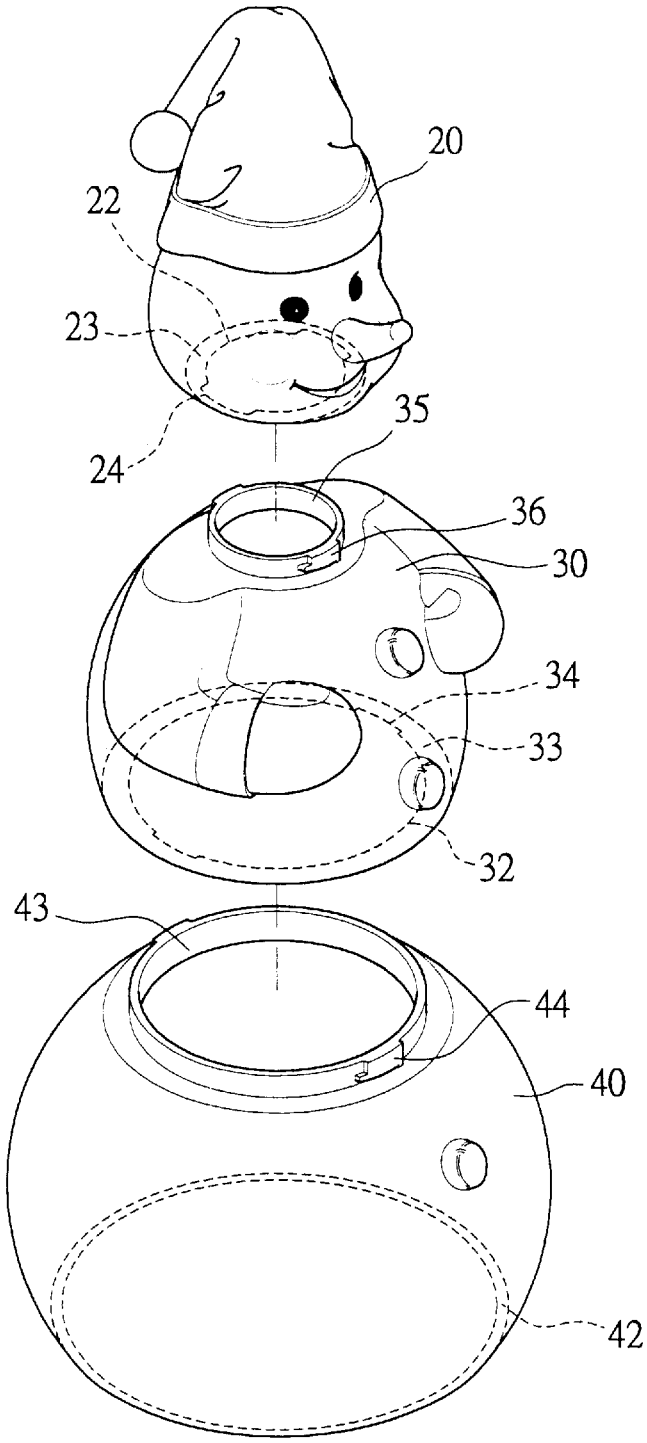
FIG. 1 is an exploded view to show a doll assembly of the present invention.
Figure 2:
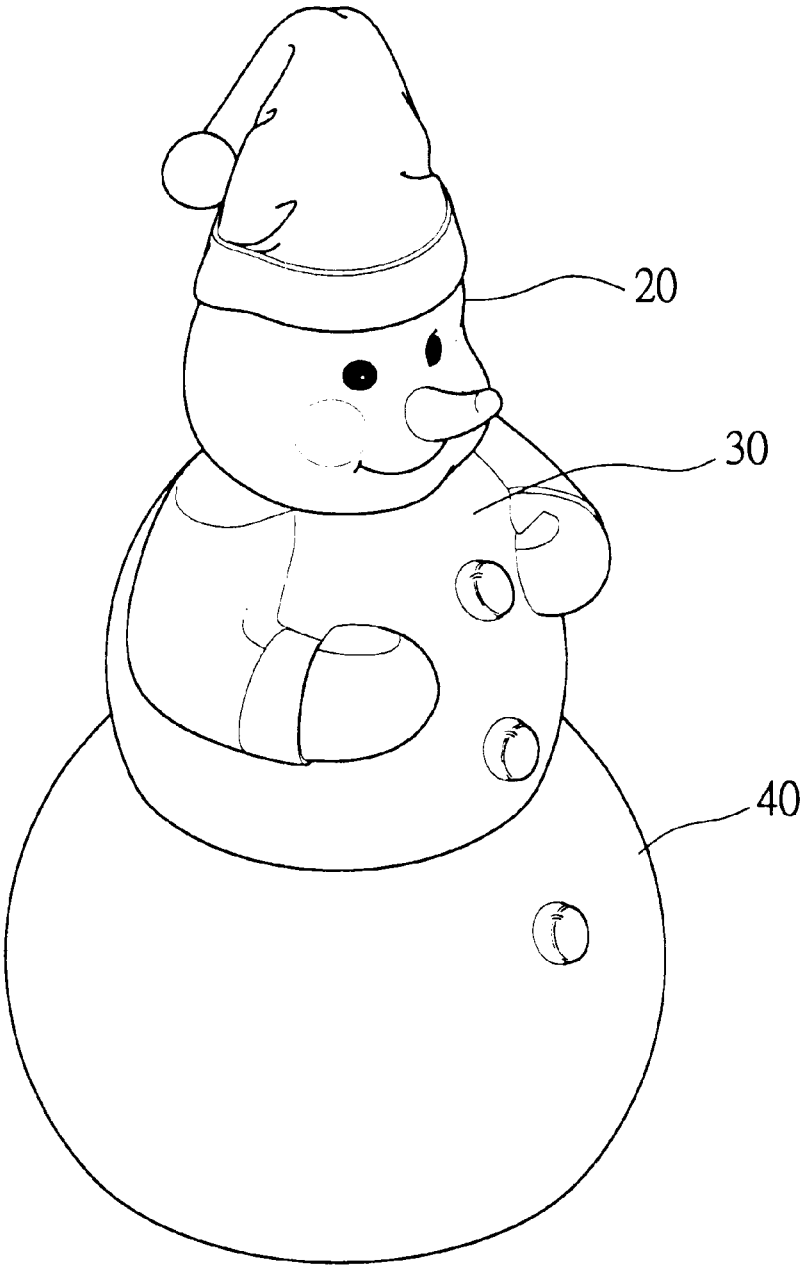
FIG. 2 is a perspective view to show the doll assembly of the present invention.

Referring to FIGS. 1 and 2, the doll assembly of the present invention comprises a first section 20, a second section 30 and a third section 40. The first section 20 is a hollow member and has a first open end 22 defined in an underside thereof. A first flange 23 extends radially inward from the first open end 22 and two first notches 24 are defined in the first flange 23. The second section 30 is a hollow member and a second flange 35 extends from a first end of the second section 30. Two first protrusions 36 extend from an outer surface of the second flange 35. The second flange 35 is inserted into the first open end 22 of the first section 20 and the first protrusions 36 are allowed to pass through the first notches 24. The first section 20 is then rotated to let the first protrusions 36 rest on the first flange 23 to connect the first section 20 and the second section 30. A second open end 32 is defined in the second section 30 and sized to allow the first section 20 to be received in the second section 30 via the second open end 32. A third flange 33 extends radially inward from the second open end 32 of the second section 30 and two second notches 34 are defined in the third flange 33.

The third section 40 is a hollow member and a fourth flange 43 extends from a first end of the third section 40. Two second protrusions 44 extend from an outer surface of the fourth flange 43. The fourth flange 43 is inserted into the second open end 32 of the second section 30 and the two second protrusions 44 pass through the second notches 34 of the second section 30. The second section 30 is then rotated to let the second protrusions 44 rest on the third flange 33 of the second section 30 to connect the second section 30 and the third section 40.

Figure 3:
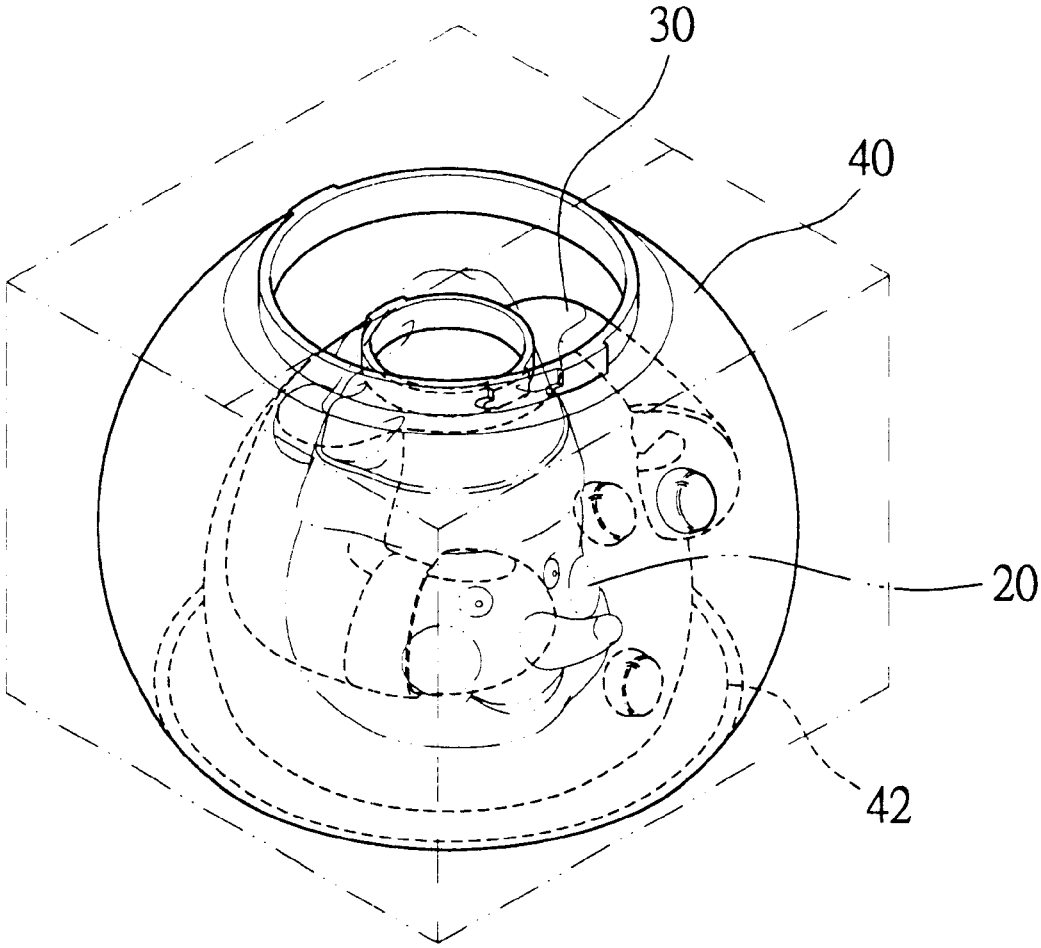
FIG. 3 is an illustrative view to show one section of the doll assembly receives the rest two sections of the present invention.
Figure 4:
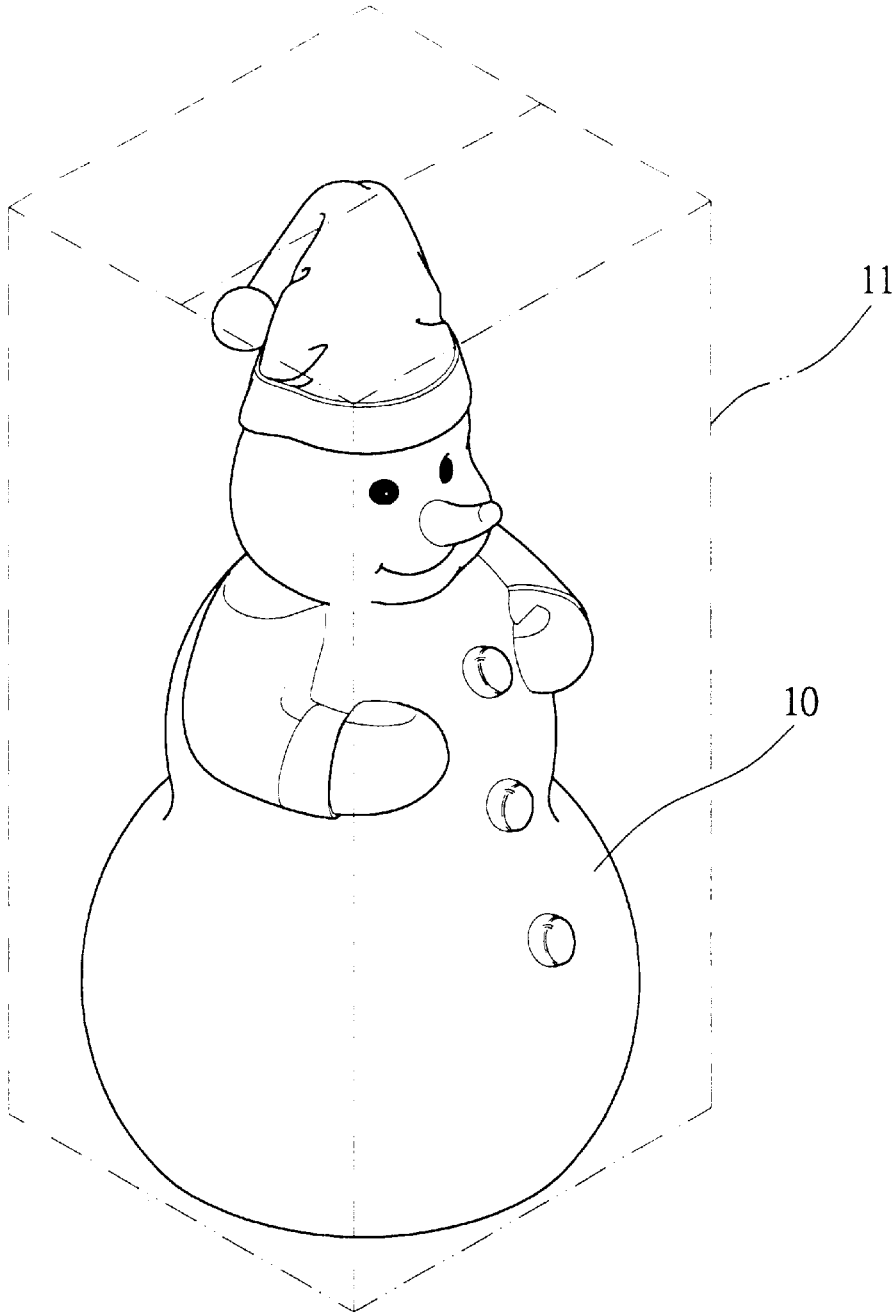
F I G.4 PRIOR ART
FIG. 4 is a perspective view to show a conventional doll in a package box.

Further referring to FIG. 3, a third open end 42 is defined in a second end of the third section 40 and the third open end 42 is large enough to receive the second section 30 in which the first section 20 is received. Therefore, the doll assembly of the present invention can be stored or transported with a small package box.

While we have shown and described various embodiments in accordance with the present invention, it should be clear to those skilled in the art that further embodiments may be made without departing from the scope and spirit of the present invention.

What is claimed is:

1. A doll assembly comprising:

a first section, a second section and a third section;

said first section having a first open end and a first flange extending radially inward from said first open end, two first notches defined in said first flange, a second flange extending from a first end of said second section and two first protrusions extending from an outer surface of said second flange, said second flange inserted into said first open end of said first section and said first protrusions passing through said first notches, and said three sections disengagably connected with each other, said third section having an open end through which said first section and said second section are received in said third section.

2. The doll assembly as claimed in claim 1 further comprising a second open end defined in said second section and said first section being received in said second section via said second open end.

3. The doll assembly as claimed in claim 2 further comprising a third flange extending radially inward from said second open end of said second section, two second notches defined in said third flange, a fourth flange extending from a first end of said third section and two second protrusions extending from an outer surface of said fourth flange, said fourth flange inserted into said second open end of said second section and said two second protrusions passing through said second notches of said second section.

4. The doll assembly as claimed in claim 3 further comprising a third open end defined in a second end of said third section and said second section being received in said third section via said third open end.

* * * * *